United States Patent [19]

Perkins

[11] Patent Number: 5,043,633

[45] Date of Patent: Aug. 27, 1991

[54] CIRCUIT AND METHOD FOR REGULATING THE CURRENT FLOW IN A DISTRIBUTORLESS IGNITION SYSTEM COIL

[75] Inventor: Luke A. Perkins, Colorado Springs, Colo.

[73] Assignee: NCR Corporation, Dayton, Ohio

[21] Appl. No.: 435,308

[22] Filed. Nov. 13, 1989

[51] Int. Cl.[5] ..... H01T 15/00

[52] U.S. Cl. ..... 315/200 R; 315/209 R; 315/209 T

[58] Field of Search ..... 315/209 R, 209 T, 291, 315/302, 307, 200 R, 208

[56] References Cited

U.S. PATENT DOCUMENTS 4,912,373 3/1990 Moreau ..... 315/209 T X

*Primary Examiner*—Robert J. Pascal

*Attorney, Agent, or Firm*—Wilbert Hawk, Jr.; Stephen F. Jewett; Douglas S. Foote

[57] ABSTRACT

A control circuit and method for regulating the current flow through a series connected inductor and transistor. The circuit comprises an operational amplifier for receiving a first voltage proportional to the current flow, for receiving a variable second voltage, and for providing a control current to the transistor which keeps the transistor out of its saturation region.

24 Claims, 2 Drawing Sheets

CIRCUIT AND METHOD FOR REGULATING THE CURRENT FLOW IN A DISTRIBUTORLESS IGNITION SYSTEM COIL

The present invention relates to a circuit for controlling the the charging and discharging of an inductor. More particularly, it relates to a circuit for regulating the operation of the primary coil winding in a distributorless ignition system.

BACKGROUND OF THE INVENTION

For many years the ignition systems in automobiles employed an electro-mechanical contact breaker, known as a distributor, to sequentially send current pulses to ignite spark plugs. More recently, these systems have been replaced with electronic ignition systems which eliminate the distributor. These so called "distributorless ignition systems" (DIS) rely on electronic switching and control of current pulses.

A typical DIS system places the primary winding of an ignition coil (an inductor) in series with a high gain transistor, such as a Darlington transistor. A control circuit is connected to the control electrode of the transistor to turn it on and off as required. During a dwell period while the primary winding is storing energy, the transistor is turned on to allow current to flow through the transistor and primary winding. When the current flow reaches its desired value, the control circuit maintains the current flow by regulating the control current supplied to the control electrode of the transistor. At the end of the dwell period, when the spark plug requires a current pulse, the control circuit is disconnected from the control electrode of the transistor shutting the transistor off. This sudden stop in current flow through the transistor causes an inductive high voltage surge in the secondary winding of the ignition coil which provides the energy for the spark.

Two problems associated with prior DIS systems are current overshoot and frequency instability in the primary winding of the ignition coil. Current overshoot is caused by turning the transistor on hard (driving it into saturation) during the dwell period. Although control circuits typically reduce the current to the transistor's control electrode as the current flow in the primary winding approaches its desired value, the transistor develops parasitic capacitances during saturation. These capacitances can build up a relatively large quantity of charge during this time which must be dissipated. Such dissipation can keep the transistor at a higher conductivity than preferred for regulation. This results in the current flow overshooting its desired value. In reducing the overcurrent by choking its flow through the Darlington transistor, a reverse voltage can appear on the primary winding of the coil causing a surge in the secondary winding and resulting in a premature firing of the spark. Overshoot can also contribute to frequency instability wherein oscillations are created in the primary winding as the control circuit attempts to regulate the current flow. Instability can be improved somewhat by using a lower gain controller. However, a low gain controller can produce an undesirable high offset in the coil current.

One way of solving overshoot is to use a fixed gain transistor. As long as the current source is tightly controlled, overshoot will not occur since the transistor controller maintains a constant current as the inductor current approaches its desired value. However, achieving a fixed gain transistor that is stable over time, temperature, power supply variations, and variations in the inductor is impractical for large production quantities. Another way to avoid overshoot is to customize an individual DIS system by adjusting the transistor controller drive current to the transistor gain. As with a fixed gain transistor, this solution can be expensive.

OBJECTS OF THE INVENTION

It is therefore an object of the present invention to provide a new and improved circuit for regulating the current flow through a series connected inductor and transistor.

It is another object of the present invention to provide a new and improved method for controlling the charging and discharging of such an inductor.

It is a further object of the present invention to provide a circuit which reduces overshoot in the primary winding of an ignition coil.

It is yet another object of the present invention to provide a circuit which reduces frequency instability in the primary winding of an ignition coil.

It is yet a further object of the present invention to provide a universal control circuit for regulating current flow in the primary winding of an ignition coil.

It is still another object of the present invention to provide an integrated circuit for regulating current flow in the primary winding of an ignition coil and which can be easily adapted for use with a variety of coils by selective replacement of externally connected components.

SUMMARY OF THE INVENTOIN

One form of the present invention is a control circuit for regulating the current flow through a series connected inductor and transistor. The circuit comprises an operational amplifier for receiving a first voltage proportional to the current flow, for receiving a variable second voltage, and for providing a control current to the transistor which keeps the transistor out of its saturation region.

Another form of the invention is a circuit comprising a voltage source, an inductor, a switching transistor series connected with the inductor between the voltage source and a reference potential terminal, and a control circuit for regulating the current flow through the inductor. The control circuit includes a sensor, generating means and an operational amplifier. The sensor provides a first voltage proportional to the current flow through the inductor. The generating means generates a variable second voltage. The operational amplifier is connected to the sensor and generating means for receiving the first and second voltages, respectively, and provides an output current to the control electrode of the transistor which keeps the transistor out of its saturation region.

Yet another form of the invention is a method for controlling the-charging and discharging of an inductor series connected with a transistor between a voltage source and reference potential terminal. A first voltage proportional to the current flow through the inductor is sensed, and a variable second voltage is generated. The first and second voltages are compared and a control current proportional to the difference of the first and second voltages is provided to a control electrode of the transistor. The control current is small enough to keep the transistor out of its saturation region.

DESCRIPTION OF A PREFERRED EMBODIMENT

Figure 1:
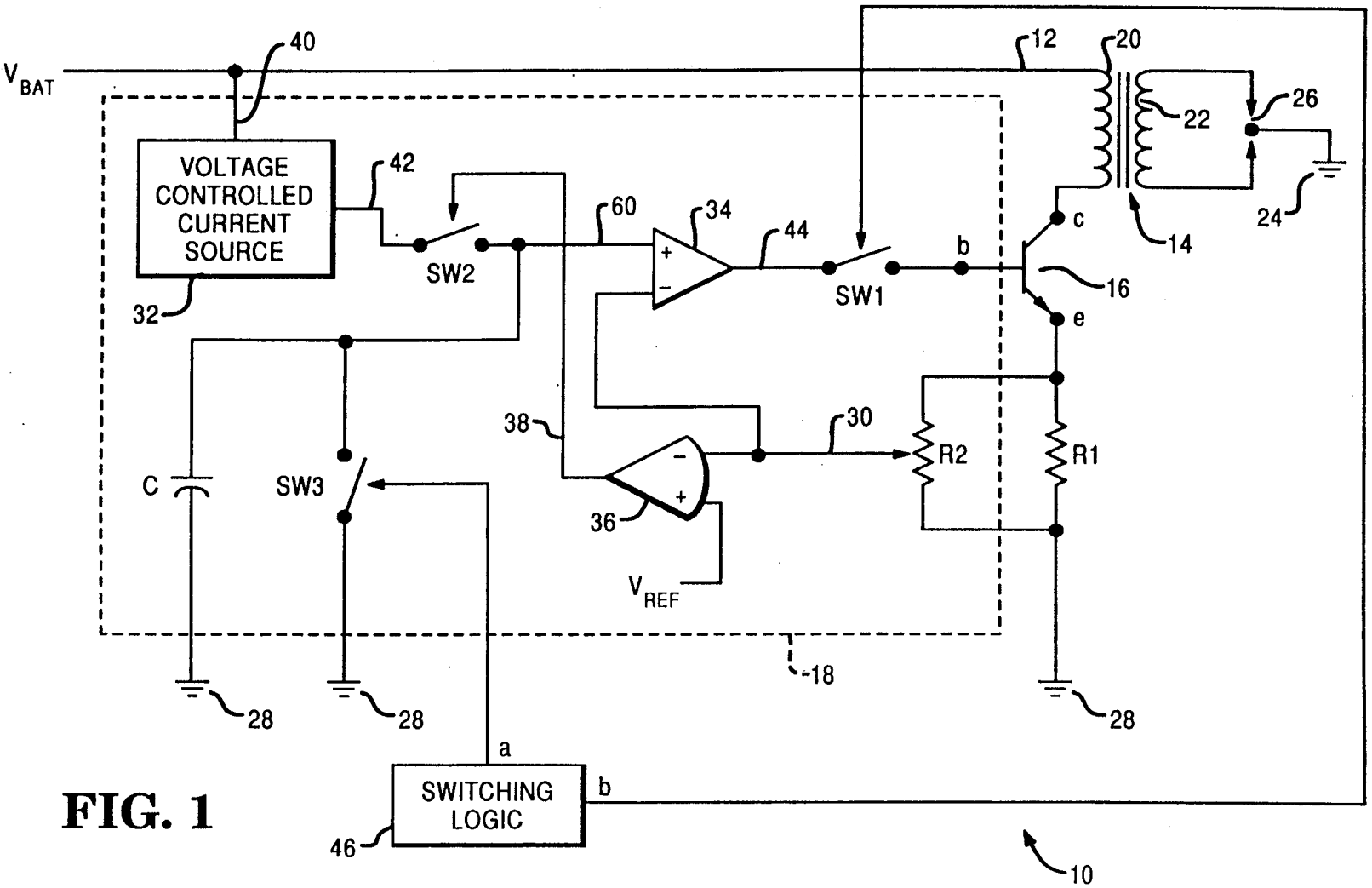
FIG. 1 is a circuit diagram showing one embodiment of the present invention.

FIG. 1 shows an electronic ignition system 10. System 10 includes a voltage source 12, an ignition coil 14, a switching transistor 16, resistor R1, and a control circuit 18. Voltage source 12 ($V_{BAT}$) is ideally a battery which in a preferred embodiment will supply about 12 volts. Ignition coil 14 includes a primary winding or inductor 20 coupled to a secondary winding 22. Secondary winding 22 is connected to a reference potential terminal 24 through a potential barrier 26, potential barrier 26 being a spark plug gap. Switching transistor 16 is a power Darlington transistor in a preferred embodiment. A Darlington transistor is a very high gain device formed by two transistors with a common collector and the emitter of the first connected to the base of the second. Transistor 16 has a collector c, emitter e, and a control electrode or base b. Transistor 16 is series connected with inductor 20 between voltage source 12 and reference potential terminal 28 (ground), with collector c connected to inductor 20 and emitter e connected to terminal 28 through resistor R1. Base b of transistor 16 is also connected to control circuit 18 as will be described more fully hereinafter.

Control circuit 18 regulates the current flow through inductor 20 and transistor 16 by varying the current provided to base b. Circuit 18 includes a sensor in the form of an input line 30 connected to resistor R2 for sensing the voltage on resistor R2. This voltage is proportional to the current flowing through inductor 20 and transistor 16 since resistors R1 and R2 are connected in parallel. Resistor R2 is much greater than resistor R1 with typical values of 1000 and 0.05 ohms, respectively. .

Control circuit 18 also includes a voltage controlled current source 32, operational amplifier 34, comparator 36, capacitor C, and switches SW1, SW2 and SW3. Comparator 36 is connected to input line 30 and receives the voltage sensed by line 30 at its (−) input. Comparator 36 receives a reference voltage $V_{REF}$ on its (+) input. Comparator 36 generates a high or low signal on its output line 38 which is connected to switch SW2. Switch SW2 is responsive to the output signal from comparator 36 for connecting voltage controlled current source 32 to capacitor C, as will be discussed more fully hereinafter.

Voltage controlled current source 32 has an input line 40 connected to voltage source 12 for receiving $V_{BAT}$, and an output line 42 for providing a current which is a function of the value of $V_{BAT}$. Current source 32 is connected to the (+) input of operational amplifier 34 through switch SW2. Capacitor C and switch SW3 are connected in parallel between the (+) input of operational amplifier 34 and reference potential terminal 28, which in a preferred embodiment is ground. When closed, switch SW3 will discharge capacitor C. Operational amplifier 34 is also connected to input line 30 and receives the voltage on line 30 at its (−) input. Operational amplifier 34 compares the voltages appearing on its (+) and (−) inputs and provides an output current proportional to the difference of these voltages on its output line 44. This output current is provided to base b of transistor 16 when connected by switch SW1.

Switching logic 46 provides digital on/off signals to switches SW3 and SW1 on lines a and b, respectively. The signals provided are related to the operation of the distributorless ignition system and are generated in a conventional manner. The timing of these signals will be discussed below.

The operation of electronic ignition system 10 may be divided into four states or operating regions. The first region is the "at rest" condition. Switch SW3 is closed and switch SW1 is open. Since switch SW1 is open, there is no current provided to the base b of transistor 16 and ideally no current will flow through inductor 20. No voltage will be developed on resistor R2 and the output of comparator 36 will be high thereby closing switch SW2. However, since switch SW3 is closed, no charge will be developed on capacitor C.

The second region is the "charge up" condition. Switch SW1 receives a signal to close and switch SW3 receives a signal to open. When switch SW3 opens, charge starts to build up on capacitor C. Operational amplifier 34 starts providing a small output current to the base of transistor 16 which allows transistor 16 to start conducting. The current flow through inductor 20 and transistor 16 develops a voltage on resistor R2. This voltage is provided to comparator 36 and operational amplifier 34. Resistor R2 is sized so that during the charge up condition the voltage on line 30 is less than $V_{REF}$. Thus, comparator 36 will continue to provide a high output signal thereby keeping switch SW2 closed. An important feature of the present invention is that capacitor C is initially discharged going into the charge up condition. When switch SW3 is opened, the voltage on capacitor C does not change instantaneously but gradually builds up in response the current from current source 32. Thus, the output current of operational amplifier 34 is initially small thereby preventing transistor 16 from being driven into saturation. As the voltage builds on capacitor C, the output current of operational amplifier 34 will tend to increase which will increase the current flow through inductor 20. However, the output current of amplifier 34 will not increase excessively since the (−) input voltage developed from resistor R2 is also increasing with increased current flow. In addition, a characteristic of capacitor C is that it will charge gradually thereby preventing the output current of operational amplifier 34 from exceeding a value which would otherwise drive transistor 16 into its saturation region. By keeping transistor 16 out of its saturation region and operating solely within its ohmic region, better regulation of the current flow through inductor 20 is achieved. More particularly, problems such as current overshoot and oscillation leading to premature firing of the spark plug are avoided. Devices other than capacitor C, voltage controlled current source 32, and switches SW2 and SW3 may be able to achieve the same result. For example, a clocked digital network and an analog to digital converter having the following operating characteristics may be employed:

(1) If the signal on switching logic 46 line "a" is active, then the output of the A/D converter provided to line 60 is zero.

(2) If the signal on switching logic 46 line "a" is inactive and the signal on line 38 is active, then the voltage provided to line 60 will be a function of time and $V_{BAT}$.

(3) If the signal on switching logic 46 line "a" is inactive and the signal on line 38 is inactive, then the voltage provided to line 60 is a constant value based on previous conditions.

The third region is the "regulation" condition. Switch SW1 is still closed and switch SW3 remains open. Resistor R2 is sized so that when the desired current flow is achieved in inductor 20 that the voltage developed on resistor R2 will be slightly greater that $V_{REF}$. Thus, comparator 36 will generate a low output signal which will open switch SW2 thereby inhibiting capacitor C from further charging. Operational amplifier 34 will hold the base bias on transistor 16 to maintain the current in inductor 20. If the charge on capacitor C should leak off reducing the output current from operational amplifier 34 and decreasing the current flow in inductor 20, the resulting drop in resistor R2 voltage will flip the output of comparator 36 to again close SW2. This will return the electronic ignition system 10 to the charge up condition.

The fourth region is the "spark plug fire" condition. Switch SW1 is quickly opened, in response to a signal from switching logic 46, thereby shutting off transistor 16. This sudden stop in current flow through transistor 16 causes an inductive high voltage surge in secondary winding 22 of ignition coil 14. This provides the energy for a spark across gap 26 to reference potential terminal 24. When switch SW1 is opened, switch SW3 is closed to discharge capacitor C. The halt in current through resistor R2 will create a high output signal from comparator 36 thereby closing switch SW2. This returns electronic ignition system 10 to the first region.

Figure 2:
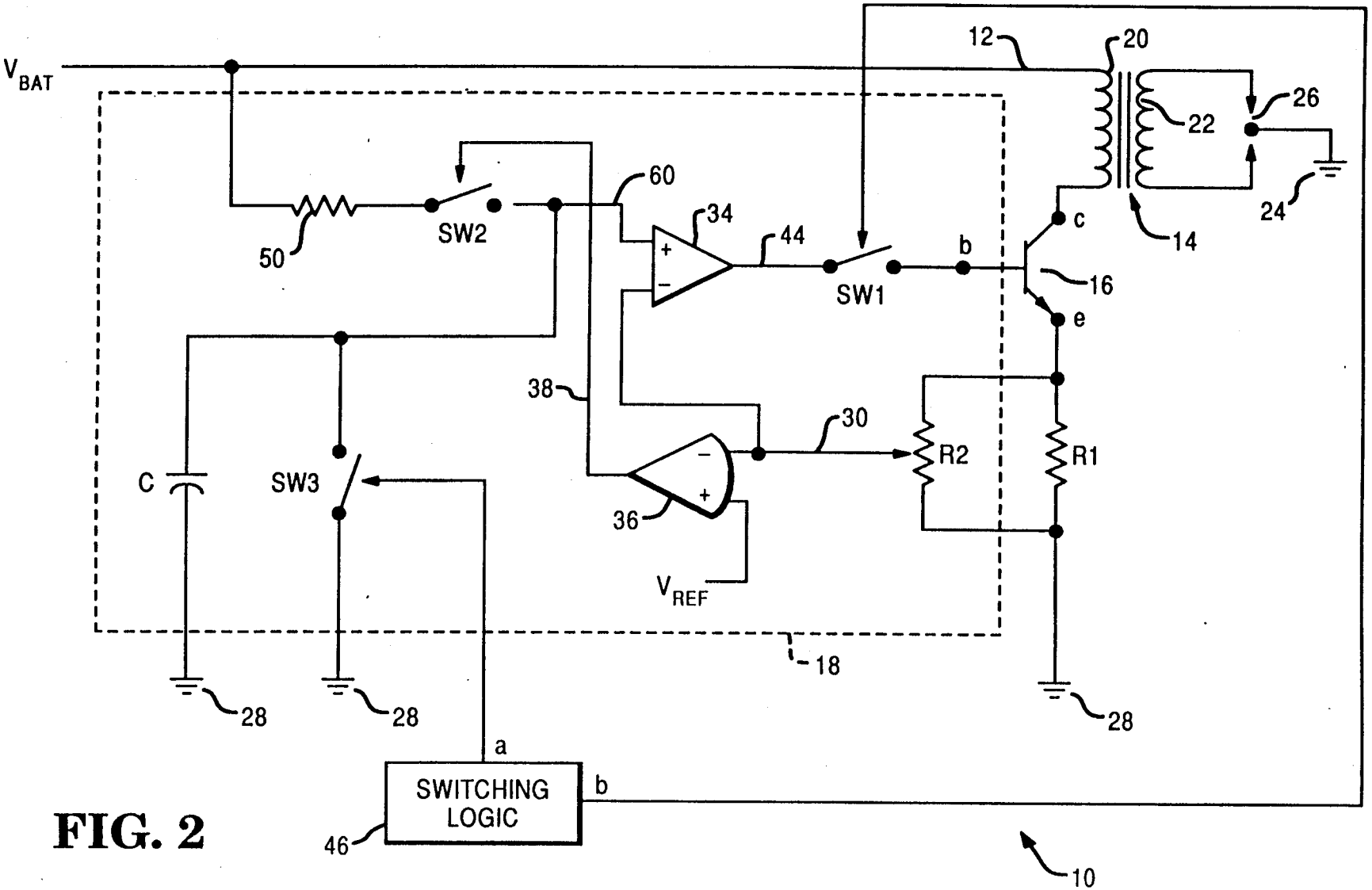
FIG. 2 is a circuit diagram showing an alternative embodiment of the present invention.

FIG. 2 shows an alternative embodiment of the present invention. Electronic ignition system 10 is similar to that shown in FIG. 1 with the exception that the voltage controlled current source 32 is replaced with a resistor 50. The operation of system 10 is similar to that described above for the FIG. 1 embodiment. The voltage on line 60 is kept at a value between 0 and 0.5 volts as the value of $V_{BAT}$ varies from about 5 to about 30 volts. Resistor 50 will approximate voltage controlled current source 32 since the current flowing through a resistor is proportional to the voltage across the resistor.

In a preferred embodiment of FIGS. 1 and 2, the elements shown in control circuit 18 absent capacitor C and resistor R2 will be formed as an integrated circuit. Capacitor C and resistor R2 will be connected externally thereto in order to allow sizing changes for different applications.

It will be clear to those skilled in the art that the present invention is not limited to the specific embodiment disclosed and illustrated herein. Nor is the invention limited to electronic ignition systems. Rather, the invention may be applied equally to any inductor which must be charged to a defined current and maintained at such current for an indefinite period.

Numerous modifications, variations, and full and partial equivalents can be undertaken without departing from the invention as limited only by the spirit and scope of the appended claims.

What is desired to be secured by Letters Patent of the United States is as follows.

What is claimed is:

1. A circuit comprising:

a voltage source;

an inductor;

a switching transistor having a control electrode, said inductor and transistor being series connected; and a control circuit for regulating the current flow through said inductor, said control circuit including:

a sensor for providing a first voltage proportional to the current flow through said inductor;

means for generating a second, variable, reference voltage, which rises when the first voltage rises; and an operational amplifier connected to said sensor and both generating means for receiving said first and second voltages at its differential inputs and providing an output current, in response to the first and second voltages, to said control electrode which keeps said transistor out of its saturation region.

2. The circuit of claim 1 wherein said control circuit further includes:

a comparator for receiving said first voltage and a reference voltage and providing an output signal; and a switch responsive to said output signal for connecting a current source to said generating means.

3. The circuit of claim 2 wherein said current soruce is a voltage controlled current source connected to said voltage source.

4. The circuit of claim 1 wherein said generating means is a capacitor connected between said amplifier and reference potential terminal.

5. The circuit of claim 4 wherein said control circuit further includes:

a switch, connected in parallel with said capacitor, for discharging said capacitor when closed.

6. The circuit of claim 1 wherein said control circuit further includes:

a switch for connecting said operational amplifier to said control electrode.

7. The circuit of claim 1 wherein said sensor comprises a resistor connected between said transistor and reference potential terminal.

8. The circuit of claim 1 wherein said transistor is a power Darlington transistor and wherein said inductor is the primary winding of an ignition coil.

9. The circuit of claim 2 wherein said current source is a resistor connected between said voltage source and said switch.

10. A circuit comprising:

a voltage source;

an inductor;

a switching transistor having a control electrode, said inductor and transistor being series connected between said voltage source and a reference potential terminal; and a control circuit for regulating the current flow through said inductor, said control circuit including:

a sensor for providing a first voltage proportional to the current flow through said inductor;

means for generating a variable second voltage;

an operational amplifier connected to said sensor and generating means for receiving said first and second voltages, respectively, and providing an output current to said control electrode which keeps said transistor out of its saturation region;

a comparator for receiving said first voltage and a reference voltage and providing an output signal;

a first switch responsive to said output signal for connecting a current source to said generating means; and a second switch for connecting said operational amplifier to said control electrode.

11. The circuit of claim 10 wherein said generating means is a capacitor connected between said amplifier and reference potential terminal and wherein said control circuit further includes:

a third switch, connected in parallel with said capacitor, for discharging said capacitor when closed.

12. The circuit of claim 11 wherein said current source is a voltage controlled current source connected to said voltage source.

13. The circuit of claim 12 wherein said sensor comprises a resistor connected between said transistor and reference potential terminal.

14. The circuit of claim 13 wherein said transistor is a power Darlington transistor and wherein said inductor is the primary winding of an iqnition coil.

15. A circuit comprising:

a voltage source;

an inductor;

a switching transistor having a control electrode, said inductor and transistor being series connected between said voltage source and a reference potential terminal; and a control circuit for regulating the current flow through said inductor, said control circuit including:

a sensor for providing a first voltage proportional to the current flow through said inductor;

means for generating a variable second voltage;

an operational amplifier connected to said sensor and generating means for receiving said first and second voltages, respectively, and providing an output current to said control electrode which keeps said transistor out of its saturation region;

a comparator for receiving said first voltage and a reference voltage and providing an output signal;

a first switch responsive to said output signal for connecting a current source to said generating means, wherein said current source is a resistor connected between said voltage source and said first switch; and a second switch for connecting said operational amplifier to said control electrode.

16. A control circuit for regulating the current flow through a series connected inductor and transistor, said control circuit comprising an operational amplifier for receiving a first voltage proportional to said current flow, for receiving a variable second voltage, said first and second voltages being received at the differential inputs of the operational amplifier, and for providing a control current to said transistor which keeps said transistor out of its saturation region.

17. The control circuit of claim 16 wherein said operational amplifier has first and second inputs for receiving said first and second voltages, respectively, said circuit further comprising a capacitor connected between said second input and a reference potential terminal and a current source connected by a switch to said second input.

18. The control circuit of claim 17 wherein said circuit further comprises a resistor connected between said transistor and a reference potential terminal and wherein said first input is connected to said resistor.

19. A method for controlling the charging and discharging of an inductor, said inductor being series connected with a transistor between a voltage source and reference potential terminal, comprising:

sensing a first voltage proportional to the current flow through said inductor;

generating a variable second voltage;

comparing said first and second voltages; and providing a control current proportional to the difference of said first and second voltages to a control electrode of said transistor to keep said transistor out of its saturation region.

20. The method of claim 19 wherein said generating step includes charging a capacitor from a current source, wherein said second voltage is developed on said capacitor.

21. The method of claim 20 further comprising:

comparing said first voltage to a reference voltage and providing a signal in response thereto; and regulating said current flow by selectively connecting and disconnecting said current source to said capacitor in response to said signal.

22. The method of claim 20 further comprising:

coupling a secondary coil to said inductor and connecting said coil to a reference potential terminal through a potential barrier; and discharging said inductor by removing said control current from said control electrode and discharging said capacitor thereby inducing a spark across said potential barrier.

23. A control for firing a spark plug, comprising:

a) an ignition coil (14) and i) a primary (20); and ii) a secondary (22) for supplying high voltage to the spark plug (26);

b) a bipolar junction transistor (16) for allowing current through the primary (20) to rise and then fall;

c) an operational amplifier (34) having i) differential inputs (+ and −) and ii) an output which feeds current to the base of the transistor (16);

d) a sensor (R2) which provides a signal i) to one differential input and ii) which indicates mangnitude of the current through the primary (20);

e) a capacitor (C) which provides a signal i) to the other differential input ii) which rises as the current in the primary (20) rises;

wherein the current fed to the base of the transistor keeps the transistor out of saturation.

24. In an electronic ignition system, containing (A) an ignition coil having primary and secondary coils (B) a transistor for controlling current through the primary of the coil, (C) a spark plug which is fired by the secondary coil, (D) a sensor for producing a sensor signal indicating current through the primary coil, and (E) a control for controlling current through the transistor, based on the difference between the sensor signal and a reference signal, the improvement comprising:

a system for causing the reference signal to rise when the current through the primary coil rises.

* * * * *